US005527199A

United States Patent [19]

Feder et al.

[11] Patent Number: 5,527,199

[45] Date of Patent: Jun. 18, 1996

[54] DISCHARGE LAMP LEAD-THROUGH CONSTRUCTION WITH A CONDUCTOR FLATTENED BY STAMPING

[75] Inventors: Reiner Feder, Simmerath; Günter Wermeester, Aachen, both of Germany

[73] Assignee: U.S. Philips Corporation, New York, N.Y.

[21] Appl. No.: 414,172

[22] Filed: Mar. 27, 1995

Related U.S. Application Data

[63] Continuation of Ser. No. 55,430, Apr. 29, 1993, abandoned.

[30] Foreign Application Priority Data

Jul. 14, 1992 [EP] European Pat. Off. ..... 92202151

[51] Int. Cl.[6] ..... H01J 09/28

[52] U.S. Cl. ..... 445/49; 445/35; 29/860; 29/874

[58] Field of Search ..... 313/623, 626, 313/315, 331, 332, 579; 445/49, 35, 26; 29/860, 874, 879, 882

[56] References Cited

U.S. PATENT DOCUMENTS

| | | | |
|---|---|---|---|
| 2,664,517 | 12/1953 | Wiener | 313/623 |
| 3,566,465 | 3/1971 | Weiner | 29/860 |
| 3,868,528 | 2/1975 | Lake et al. | 313/623 |
| 4,002,939 | 1/1977 | Van Bragt . | |
| 4,110,657 | 8/1978 | Sobieski | 313/332 |
| 4,254,356 | 3/1981 | Karikas | 313/623 |
| 4,550,269 | 10/1985 | Dixon | 313/331 |
| 4,703,221 | 10/1987 | Ochoa et al. | 313/579 |
| 4,835,439 | 5/1989 | Essock et al. | 313/623 |
| 4,959,587 | 9/1990 | Schug | 445/49 |

FOREIGN PATENT DOCUMENTS

| | | |
|---|---|---|
| 1927796 | 7/1970 | Germany . |

*Primary Examiner*—P. Austin Bradley
*Assistant Examiner*—Jeffrey T. Knapp
*Attorney, Agent, or Firm*—Brian J. Wieghaus

[57] ABSTRACT

The electric lamp has a quartz glass lamp vessel (1) in the wall (2) of which metal foils (4) are embedded to which internal current conductors (5) and to a flat end portion (8) of which external current conductors (6) are connected. The end portions (8) are eccentrically flattened by means of stamps (20, 21) so as to have a plane (7) to which the center line (9) of the external current conductor (6) is substantially coincident. The occurrence of cracks and facture of the metal foils (4) is thereby counteracted.

6 Claims, 2 Drawing Sheets

DISCHARGE LAMP LEAD-THROUGH CONSTRUCTION WITH A CONDUCTOR FLATTENED BY STAMPING

This is a continuation of application Ser. No. 08/055,430, filed Apr. 29, 1993 now abandoned.

BACKGROUND OF THE INVENTION

The invention relates to an electric lamp comprising:

a lamp vessel which is closed in a vacuumtight manner and has a quartz glass wall;

an electric element and a filling in the lamp vessel;

metal foils embedded in the lamp vessel wall and each connected to a respective internal current conductor extending to the electric element and to a respective external current conductor made of molybdenum, which external current conductors issue from the wall to the exterior, each have a contact face at an end portion thereof and a centerline which substantially coincides with said contact face, the corresponding metal foil being welded to the said contact face.

Such an electric lamp is known from U.S. Pat. No. 4,002,939.

A body in the shape of a foil is used in lamps having a lamp vessel of quartz glass, i.e. glass having an $SiO_2$ content of at least 96% by weight, for obtaining a vacuumtight seal on a metal body having a strongly different coefficient of linear thermal expansion, $54*10^{-7}$ and $45*10^{-7}$ for molybdenum and tungsten, respectively, as compared with approximately $10*10^{-7}$ for quartz glass. Depending on its width, the foil is thin, for example, approximately a hundred μm for a width of 1 cm, to very thin, for example, a few tens of μm, for example, 30 μm for a width of, for example, 2 mm. The small thickness renders the foil mechanically vulnerable. The external and the internal current conductors are much thicker for providing a sufficient conductance and a sufficient mechanical strength.

The conductors are laterally connected to the metal foil with overlaps. When a metal foil with an external and an internal current conductor connected thereto is embedded in the wall of a lamp vessel, in a pinched seal or in a fused seal, the glass centers the current conductors in the said seal. The metal foil is also centered in a zone situated between the conductors. In the vicinity of the current conductors and laterally of these conductors, however, the foil cannot be centered. This is because the conductors themselves are centered, and the foil has its ends laterally of these centered conductors.

Because of its partly centered, partly eccentric situation, the metal foil follows a curved and/or kinked path. This path leads to tensional stresses in the foil which may lead to cracks. A reduced electric conductance, an increased heat generation in the wall, and a reduced luminous efficacy of the lamp are the results of this. There is even a risk of fracture of the foil, and thus of lamp failure immediately upon manufacture or shortly afterwards.

The external current conductor in the known lamp has a contact face which substantially coincides with its centerline. As a result, the foil has a substantially linear shape up to the welded joint at this conductor, and the creation of cracks and fractures is counteracted. The contact face is obtained in that the conductor is ground off at its end down to the centerline.

A disadvantage of this is the laboriousness thereof and the pollution caused by grinding. Another disadvantage is the reduced conductance of the external current conductor at the very spot of the welded joint owing to its smaller thickness.

DE 1 927 796 discloses an electric lamp in which the metal foil has a thickened portion on which a welded joint is made to a flat, widened end portion of the external current conductor. The metal foil follows a curved or kinked path at the external current conductor also in this lamp.

SUMMARY OF THE INVENTION

It is an object of the invention to provide an electric lamp of the kind described in the opening paragraph which is readily manufactured and in which the risk of damage to the metal foil is counteracted.

According to the invention, this object is achieved in that the end portion of the external current conductor is formed by eccentrically stamping said end portion.

The external current conductor with its shaped end portion may be readily and quickly stamped by means of a profiled punch and a die, which may be without profile, cooperating so as to form the end portion of the external current conductor in one stroke, each making contact with an adjoining portion of said conductor during this. Material is displaced thereby, and substantially nothing is removed. If external current conductors of a certain kind have a constant thickness, it is possible to let the centerline coincide with the contact face, or even to compensate for the thickness of the metal foil. The centerline may then run 10 μm away from the contact face for a metal foil of 20 μm, so that the centerline of the external current conductor goes through the center of the metal foil.

It is noted that an eccentrically flattened end portion may have a much greater thickness, half the diameter of the external current conductor with a comparatively small width increase, than a centrically flattened portion. An eccentrically flattened portion of a 700 μm conductor has a contact face substantially on the centerline and a thickness of 350 μm. If a contact face is desired at a distance from the centerline, for example, at a distance of 150 μm, in the case of a centrically flattened portion, the flattened portion is nevertheless only 300 μm thick and has a considerable width which is electrically useless.

The external current conductor of a lamp is generally comparatively thick, for example, for avoiding electric power losses or for providing sufficient strength for gripping the lamp thereon and fastening it to other conductors, for example, for using this conductor as a plug pin of, for example, 0.7 mm diameter for joining it to a connector or to a lampholder.

The internal current conductor is much thinner than the external one in many lamp types. The internal current conductor may be a leg of an incandescent body which is present as an electric element in the lamp vessel, for example, in the case of an electric incandescent lamp. Such a leg is in general thinner than 300 μm. Such an incandescent lamp may have a filling comprising halogen. Alternatively, the internal current conductor in an incandescent lamp may be a wire which, for example, has been screwed into or around the incandescent body. In a discharge lamp the internal current conductor is also often thinner than the external one in order to achieve that the electrode connected to said conductor or formed by a free end portion of said conductor assumes a sufficiently high temperature during operation. With a comparatively thin conductor, ≦300 μm, the deformation of a metal foil in the lamp vessel wall, and thus the risk of damage is small, in contrast to the situation with a comparatively thick conductor. If so desired, however, the internal current conductor may also be made flatter in the end portion of its fastening to the metal foil or may have an eccentrically flattened end portion fastened thereto.

The metal foils may be embedded in the lamp vessel wall next to one another, or at a distance from one another, for example, opposite one another. The lamp may or may not have an outer envelope around the lamp vessel and may or may not be provided with a lamp cap.

BRIEF DESCRIPTION OF THE DRAWINGS

An embodiment of the electric lamp according to the invention is shown in the drawing, in which.

DESCRIPTION OF THE PREFERRED EMBODIMENTS

Figure 1:
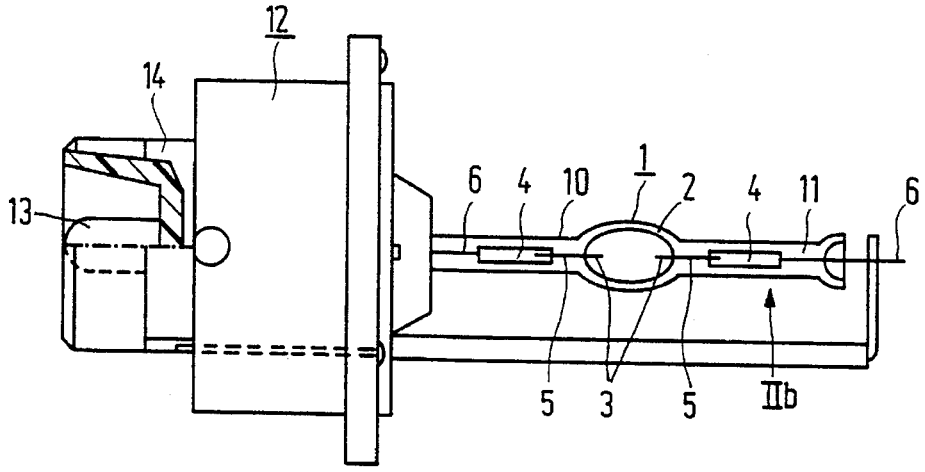
FIG. 1 shows a lamp in side elevation.

The electric lamp of FIG. 1 has a lamp vessel 1 which is closed in a vacuumtight manner and which has a quartz glass wall 2 and an electric element 3, and a filling inside. Metal foils 4 are embedded in the lamp vessel wall and connected to respective internal current conductors 5 extending to the electric element and to respective external current conductors 6 made of molybdenum. The lamp shown is an electric discharge lamp in which the free end portions of the internal current conductors 5 form the electric element 3, i.e. tungsten electrodes. The lamp vessel has a filling of mercury, sodium iodide and scandium iodide, and xenon, for example, with a pressure of 7 bar at room temperature.

The external current conductors 6 issue from the wall 2 to the exterior and each have a contact face 7 (FIG. 2) at an end portion 8 thereof and a centerline 9 substantially coinciding with this contact face. The relevant metal foil 4 is welded to the contact face 7.

The end portion 8 of each external current conductor 6 is eccentrically flattened (see FIG. 2).Thereby, the external current conductors each have an eccentrically located flattened end portion having a contact face, said contact face substantially coinciding with the centerline of the main portion of the external current conductors.

In the electric lamp shown, the metal foils, made of molybdenum in the Figure, are embedded in the lamp vessel wall opposite one another in pinched seals 10, 11 from which also the internal current conductors enter the interior opposite one another. The lamp vessel 1 is fixed in a lamp cap 12 which has contacts 13, 14. The lamp consumes a power of approximately 35 W during operation and is suitable for use in an optical system, for example, as a vehicle headlamp.

Figure 2:
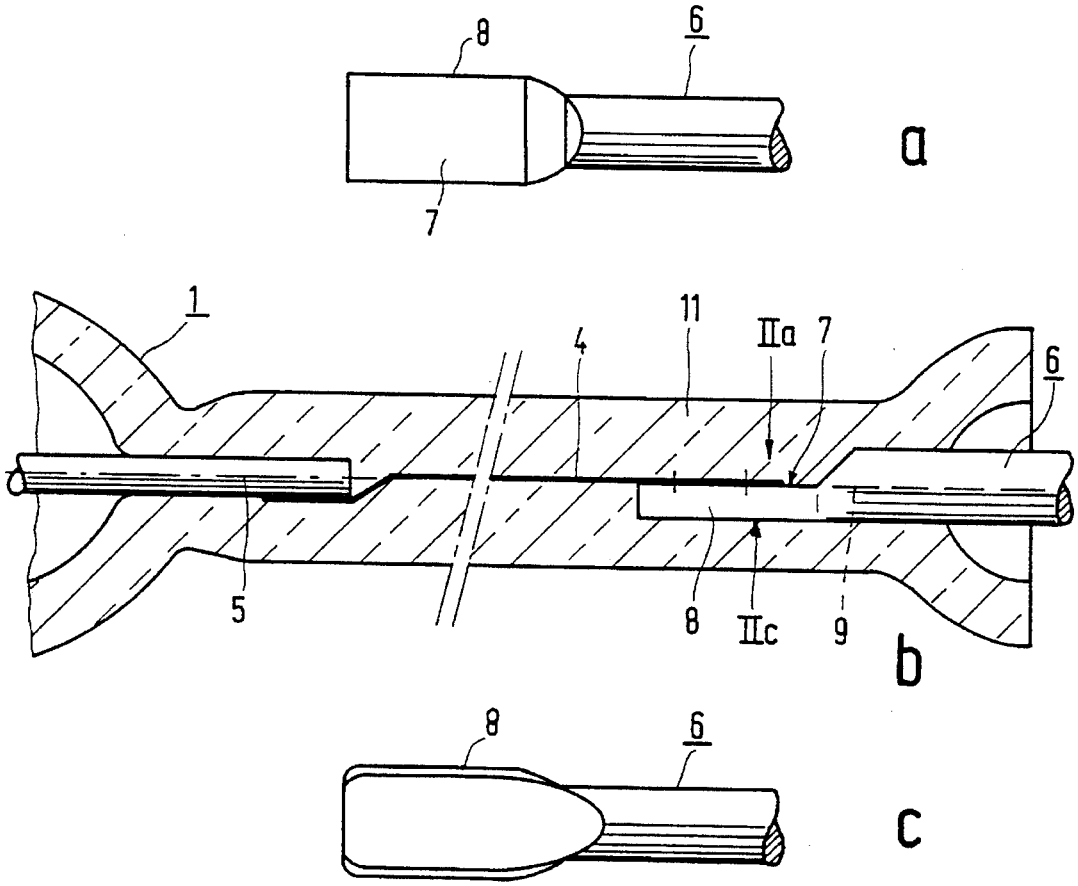
FIG. 2*a, b, c* show details of FIG. 1 on an enlarged scale.

It is visible in FIG. 2 that the thickness of the external current conductor 6, which is 400 μm, has only been halved locally and that its width as a result has increased only little although the flattened end portion 8 having the contact face 7 for the metal foil has a surface substantially on the centerline 9 of the main portion. The internal current conductor 5 has a thickness of 200 μm and accordingly moves the foil only 100μm sideways. The metal foil 4 lies in a straight line, except for the slight deviation at the internal conductor, in the seal 11. It has been found that the construction of the lamp according to the invention counteracts the risk of cracks and/or fractures of the metal foil effectively.

Figure 3:
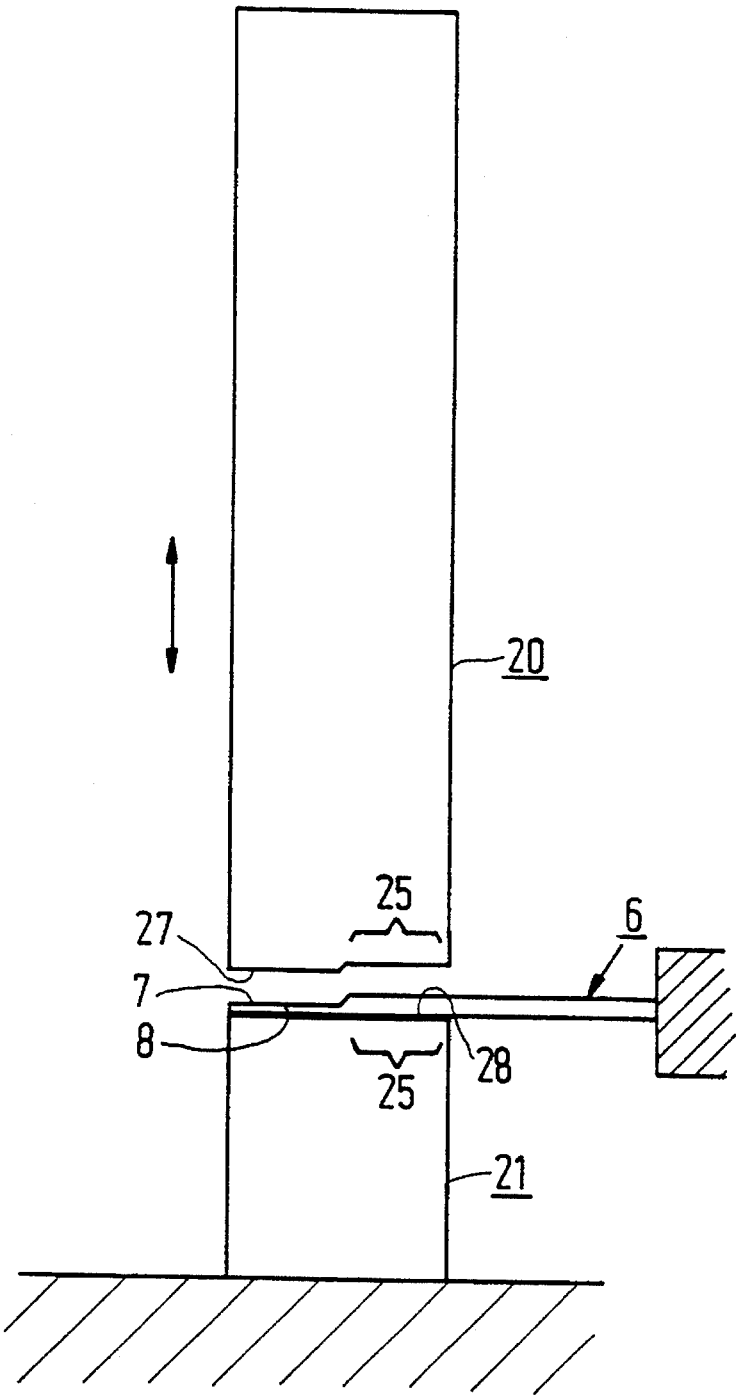
FIG. 3 shows a punch and die used in the manufacture of the lamp.

The punch and die 20, 21 of FIG. 3 made of, for example, HSS, have a profiled surface 27 for shaping the contact face 7 and a surface 28 without profile, respectively, for jointly forming the flattened end portion 8 of the external current conductor 6 in one stamping stroke. The die 21 could alternatively also have a profile, for example, a cylindrically concave recess for accommodating the conductor 6. The punch and die 20, 21 have a zone 25 in which they touch (or in the Figure: have touched) the conductor 6 in an area adjoining the eccentrically flattened end portion 8. The eccentricity is realised in this way and a curvature of the conductor 6 is prevented.

We claim:

1. A method of manufacturing a conductive lead-through assembly for a high pressure discharge lamp, comprising:

providing a pair of current conductors, at least one of which has an end portion with a substantially circular cross-section and a centerline;

providing a metal foil having a thickness dimension;

providing an internal current conductor;

forming a planar contact face on said end portion of said one external current conductor, aligned with said centerline of said end portion substantially within the thickness dimension of said metal foil, by eccentrically stamping said end portion relative to said centerline with a punch and die so that (i) substantially no material is removed (ii) said end portion has a substantially semi-circular cross-section widened in the region of said contact face; and welding said foil to said planar contact face on said one current conductor and to the other current conductor.

2. A method according to claim 1, wherein said end portion of said one current conductor has, prior to said stamping, a diameter of about 400 μm.

3. A method according to claim 1, wherein said metal foil has a thickness dimension, and said planar contact face is stamped offset from said centerline of said end portion by about one half of said thickness dimension so that the said foil is substantially aligned with said centerline upon said welding to said planar contact face.

4. A method according to claim 1, wherein said one current conductor consists of molybdenum.

5. A method according to claim 5, wherein said end portion of said one current conductor has, prior to said stamping, a diameter of about 400 μm.

6. A method according to claim 1, wherein said metal foil has a thickness dimension, and said planar contact face is stamped offset from said centerline of said end portion by about one half of said thickness dimension so that the said foil is substantially aligned with said centerline upon said welding to said planar contact face.

* * * * *